United States Patent [19]

Ueno et al.

[11] 4,017,222

[45] Apr. 12, 1977

[54] PUMP FOR USE IN A PAINT APPLICATION APPARATUS

[75] Inventors: Yoshiaki Ueno; Yoshio Nishiumi, both of Tokyo; Yukio Nagasaka, Kawagoe, all of Japan

[73] Assignee: Atom Chemical Paint Co., Ltd., Tokyo, Japan

[22] Filed: Sept. 24, 1975

[21] Appl. No.: 616,291

[30] Foreign Application Priority Data

Nov. 26, 1974 Japan ..... 49-135177

[52] U.S. Cl. ..... 418/46; 418/206

[51] Int. Cl.[2] ..... F04C 15/00; F04C 1/14

[58] Field of Search ..... 418/206, 104, 46

[56] References Cited

UNITED STATES PATENTS

| | | | |
|---|---|---|---|
| 258,535 | 5/1882 | Kidder | 418/46 |
| 2,633,807 | 4/1953 | Collura | 418/206 |
| 2,836,125 | 5/1958 | Funk | 418/206 |
| 3,150,600 | 9/1964 | Hartley | 418/46 |
| 3,191,545 | 6/1965 | Funk | 418/206 X |
| 3,360,191 | 12/1967 | Yamamoto | 418/178 X |
| 3,799,713 | 3/1974 | Cloots | 418/206 |

*Primary Examiner*—C. J. Husar
*Assistant Examiner*—Leonard Smith
*Attorney, Agent, or Firm*—Armstrong, Nikaido & Marmelstein

[57] ABSTRACT

A pump for use in a paint application apparatus which is so constructed that there is provided a clearance between an appropriate portion of an internal surface of a casing of the pump and an external periphery of protruded portions of a rotor of the pump, and there is provided another clearance between an internal periphery of the protruded portions of the rotor and an external periphery of a cylinder section of a grand box of the pump. Further, in the pump, an appropriate portion of the internal surface of the casing of the pump, the external and internal peripheries of the rotor of the pump and the external periphery each of the cylinder section of the grand boxes are made hard by quenching, applying thereto an extremely hard alloy or spraying thereonto a hard material such as molybdenum. With the arrangement mentioned above, a paint including a vast plurality of glass beads and aggregates such as a silica and limestone in the form of sand, can be pressedly conveyed without any difficulty and consequently, the pump can retain a long and useful life.

2 Claims, 2 Drawing Figures

PUMP FOR USE IN A PAINT APPLICATION APPARATUS

Figure 1:
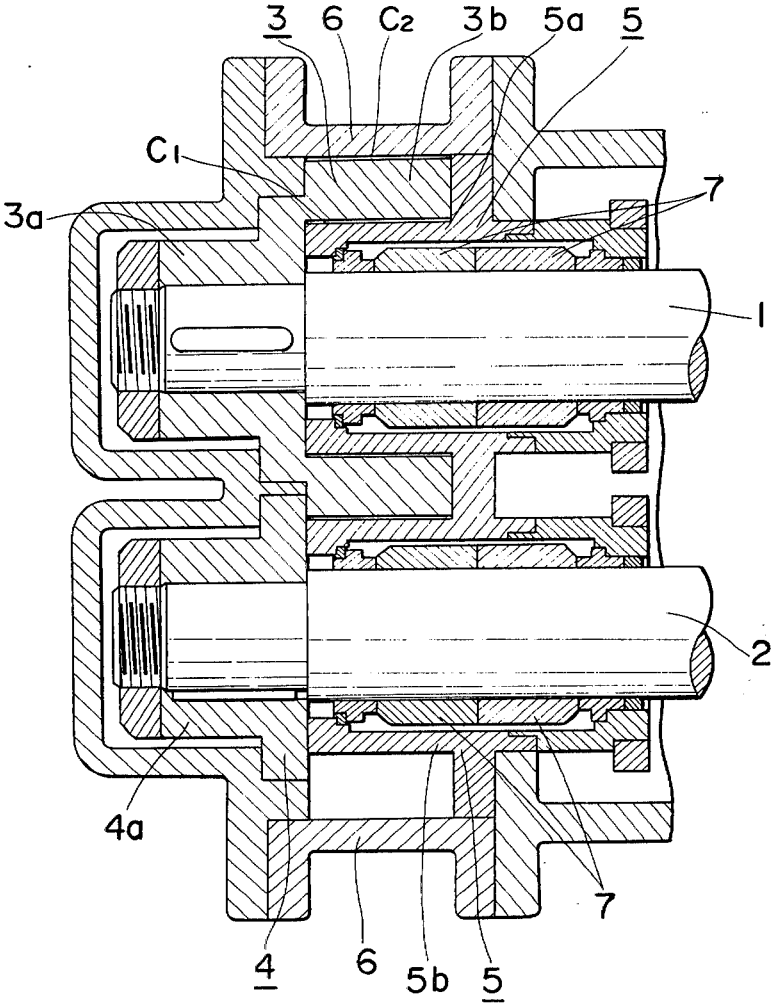

This invention relates to a pump for use in a paint application apparatus for drawing lines on road surfaces for traffic control and more particularly, to a pump for use in an apparatus for applying a paint, including glass beads and aggregates such as silica and limestone in the form of sand, to spray the paint to draw lines such as center lines, side lines and crossing lines of the road surface for traffic control.

Heretofore, feeding of the paint used in drawing lines on the road surface for traffic control, has been carried out under an air pressure of approximately 1 – 10 $Kg/cm^2$ and no pump could have been successfully used for the purpose mentioned above. The reason for this lies in that a vast plurality of glass beads which have a particle size of 1 mm at maximum, are mixed in the paint to provide the paint with a visibility in the dark. Further, in the paint, there are included necessary amounts of silica and the limestone in the form of sand to relieve the contraction of the paint when it is cooled during hardening. Furthermore, in use, the paint is heated as hot as 200° C for melting. Under the conditions mentioned above, a conventional pump has always been accompanied by the defects such as 1) when the paint in the paint tank is exhausted, spraying operations must be suspended to resupply the paint, 2) in operation, the glass beads and the aggregates intrude into the portions which directly contact the paint and interfere in the rotation of the rotors, 3) the pump can retain only a short life in use due to the wear of the portions mentioned above, 4) the paint tends to leak from sealed portion around the shafts of the pump, and 5) the pump tends to be easily deformed at its portions which directly contact with the heated paint including the materials.

An object of this invention is to provide a pump for use in a paint application apparatus, which pump is provided with clearances between the casing and rotors and between the rotors and the grand boxes to permit smooth feeding of paint. In the pump, the casing, the rotors and the grand boxes are arranged in such a manner that the glass beads, the silica and the limestone in the form of sand which has a particle size of 1 mm at maximum and is included in the paint, smoothly pass through the clearances. In the pump so arranged, the rotors smoothly rotate to forcibly feed the paint for drawing lines on the road surface.

Another object of this invention is to provide a pump of the character described, which is durable and retains a long and useful life.

These and other objects, features and advantages will be apparent to those skilled in the art from the following detailed description and the appended claims.

Essentially, according to the present invention, there is provided a pump for use in a paint application apparatus comprising a casing, a pair of shafts mounted to the casing and adapted to rotate in opposite directions to each other at a predetermined speed, a pair of rotors each of which has a boss portion and one or more protruded portions formed integrally with the rotor, said rotors being connected at their respective boss portions to end portions of the respective shafts, and a pair of grand boxes each having a cylinder section which is positioned between one of said shafts and the protruded positions through a heat resistive mechanical seal.

Figure 2:
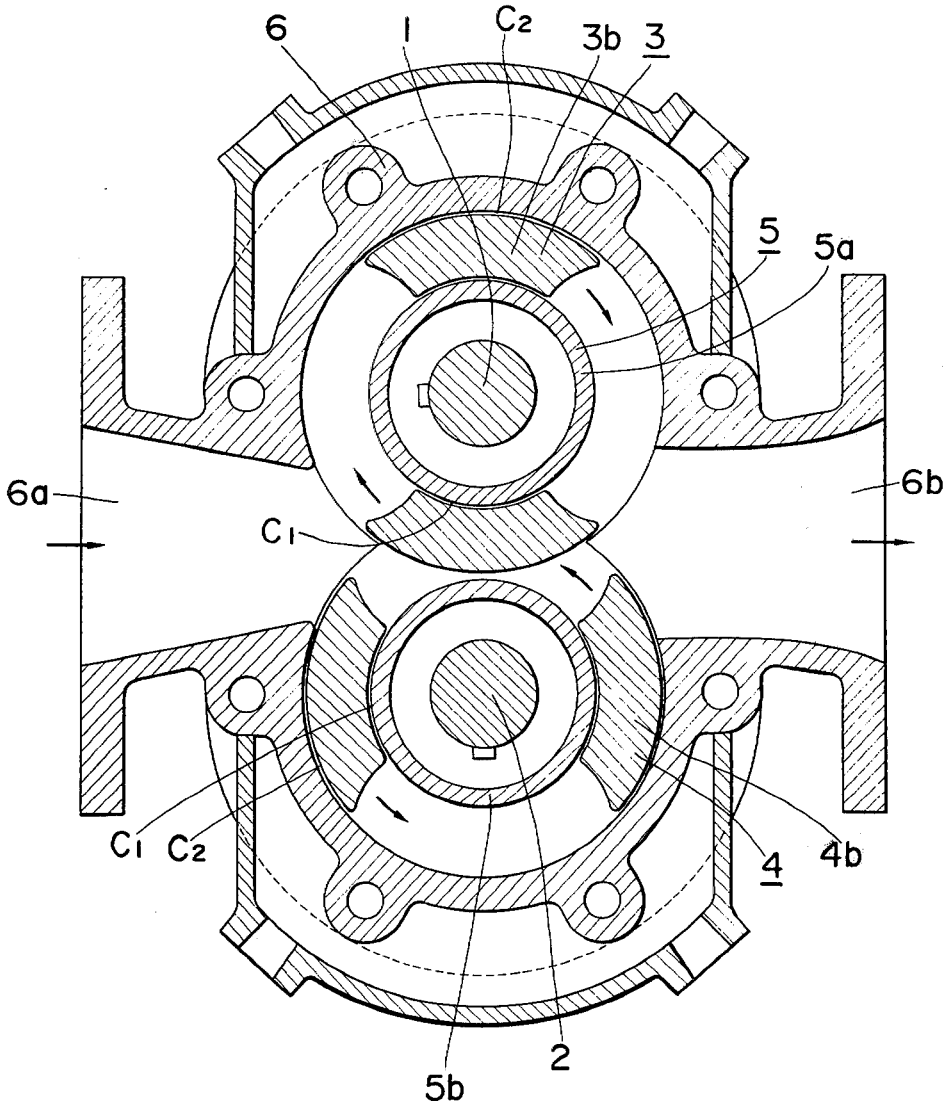

This invention will now be more particularly described with reference to the accompanying drawings in which:

FIG. 1 shows a vertical sectional side view of a pump embodying the present invention; and FIG. 2 shows a vertical elevational sectional view of the pump in FIG. 1.

Referring now to FIGS. 1 and 2, there is shown a pump for pressure-feeding paint to be used for drawing lines on the road surface and which comprises a casing 6, a pair of shafts 1 and 2 mounted to the casing 6, with each of the shafts 1 and 2 being provided at one end with a toothed wheel (not shown) as part of a gearing mechanism (not shown). The toothed wheel of the shaft 1 is in mesh with the toothed wheel of shaft 2. Numerals 3 and 4 represent rotors, each of which is provided with a boss portion 3*a* and 4*a*. Further, each of the rotors is provided with one or more protruded portions 3*b* and 4*b* formed integrally with the rotors and engagedly connected at its boss portion 3*a* or 4*a* to another end each, of the shafts 1 and 2. Both of the rotors 3 and 4 are so constructed that the protruded portions 3*b* of the rotor 3 are positioned between the protruded portions 4*b* of the rotor 4. Numeral 5 represents a pair of grand boxes, each of which is provided with a cylinder section 5*a* and 5*b*. Each of the shafts is fitted in a hollow portion of the cylinder section 5*a* and 5*b* through a double mechanical seal 7 made of an extremely hard alloy.

Further, an internal periphery of the protruded portions 3*b* and 4*b* of the rotors 3 and 4 is disposed so as to enclose the external periphery of each cylinder secton 5*a* and 5*b* of the grand boxes 5 with a clearance C1 formed between them. There is formed a further clearance C2 between the external periphery of the protruded portions 3*b* and 4*b* of the rotors 3 and 4 and an appropriate portion of an internal surface of the casing 6. The pump is so constructed that the clearances C1 and C2 which are formed between the internal periphery of the protruded portions 3*b* and 4*b* of the rotors 3 and 4 and the external periphery of each cylinder section 5*a* and 5*b* of the grand boxes 5, and between the external periphery of the protruded portions 3*b* and 4*b* of the rotors 3 and 4 and the appropriate portion of an internal surface of the casing 6, have a distance equal to the diameter of the largest particle of the glass beads and the aggregates such as the silica and the limestone in the form of sand included in the paint. Numeral 6*a* indicates an inlet for the paint and numeral 6*b* indicates an outlet for the paint. The inlet and the outlet are formed on the casing 6 as shown in FIG. 2.

In the pump, the portions such as the appropriate portion of the internal surface of the casing, the external and internal peripheries of the protruded portions 3*b* and 4*b*, and the external periphery of the grand boxes 5 are made harder than the glass beads and the aggregates included in the paint by quenching, applying an extremely hard alloy or spraying thereonto a hard material such as molybdenum. For example, the appropriate portion of the internal surface of the casing of the pump, the external and internal peripheries of the protruded portions 3*b* and 4*b* of rotors 3 and 4 and the external periphery of each cylinder section 5*a* and 5*b* of the grand boxes are made as hard as a Rockwell hardness of 50.

Further, though it is not shown in the accompanying drawings, an oil seal having a pressure larger than the pressure which is generated by the operation of the pump, is provided by an appropriate device (not shown) between the internal periphery on each of the grand boxes 5 and the external periphery of the heat resistive mechanical seal 7 to prevent the paint which includes the glass beads and aggregates, from intruding into the gap between the external periphery on each of the shafts and the heat resistive mechanical seal 7.

In operation, the pump of the present invention is located between the paint tank and the paint sprayer of the apparatus for drawing lines on the road surface with its inlet 6*a* connected with the paint tank through a conduit and its outlet 6*b* connected with the paint sprayer through an appropriate means such as a conduit.

The pair of shafts 1 and 2 are rotated with the same speed in the directions shown by the arrows in FIG. 2 by a motor (not shown) through an appropriate gearing mechanism. Thus, the paint including the glass beads and the aggregates can be forcibly pressure-fed to the outlet 6*b* by the protruded portions 3*b* and 4*b* of the rotors 3 and 4. In a situation where some of the aggregates in the paint intrude into the clearances C1 and C2 provided between the internal surface of the casing 6 and the external periphery of the protruded portions 3*b* and 4*b* of the rotors 3 and 4 and further into the gap between the internal periphery of the protruded portions 3*b*, 4*b* of the rotors 3, 4 and the cylinder sections 5*a*, 5*b* of the grand boxes 5, those glass beads and aggregates which are included in the paint do not eat into the portions of the pump which directly contact the glass beads and the aggregates, but are smoothly pressure-fed by the protruded portions 3*b* and 4*b* of the rotors 3 and 4 to the outlet 6*b* due to the provision of the clearances C1 and C2 between them. Further, in the pump, the portions which directly contact the paint are made harder than the glass beads and the aggregates which are included in the paint. The pump is so constructed that when the paint in the paint tank is exhausted, the paint is re-supplied to the paint tank while the spraying of the paint is continuously carried out, since no pressure is required to be exerted on the paint in the paint tank. Further, the pump smoothly feeds the paint without any difficulty and consequently, retains a long and useful life.

Furthermore, as is described in the specification, each of the rotors is provided with a pair of protruded portions. However, the number of the protruded portions of the rotors may be varied in accordance with necessity.

What is claimed is:

1. A pump for use in a paint application apparatus comprising a casing, a pair of shafts mounted to the casing and adapted to rotate in opposite directions to each other at a predetermined speed, a pair of rotors each of which has a boss portion and one or more protruded portions formed integrally with the rotor, said rotors being connected at their respective boss portions to end portions of the respective shafts, and a pair of grand boxes each having a cylinder section which is positioned between one of said shafts and the protruded portions through a heat resistive mechanical seal, wherein the casing, rotors and grand boxes are so disposed as to form clearances therebetween which are substantially equal to the diameter of the largest particles included in the paint.

2. A pump claimed in claim 1, wherein an internal surface of the casing, external and internal peripheries of the protruded portions of the rotors, and an external periphery each of the cylinder section of the grand boxes have hard surfaces.

* * * * *